United States Patent [19]

Tomlinson

[11] Patent Number: 4,655,508

[45] Date of Patent: Apr. 7, 1987

[54] TOOL COMPONENT

[76] Inventor: Peter N. Tomlinson, 315 Enford Road, Mondeor, Johannesburg, South Africa

[21] Appl. No.: 647,630

[22] Filed: Sep. 5, 1984

[30] Foreign Application Priority Data

Sep. 5, 1983 [ZA] South Africa ..... 83/6566

[51] Int. Cl.[4] ..... E21B 10/62

[52] U.S. Cl. ..... 299/79; 175/410; 175/413

[58] Field of Search ..... 175/329, 410, 413, 374; 299/79, 91, 86

[56] References Cited

U.S. PATENT DOCUMENTS 3,807,804 4/1974 Kniff ..... 299/91
4,073,354 2/1978 Rowley et al. ..... 175/329
4,086,973 5/1978 Keller et al. ..... 175/374
4,325,439 4/1982 Vezirian ..... 175/329

FOREIGN PATENT DOCUMENTS 0103391 2/1984 South Africa ..... 175/329

*Primary Examiner*—James A. Leppink
*Assistant Examiner*—Matthew Smith
*Attorney, Agent, or Firm*—Scully, Scott, Murphy & Presser

[57] ABSTRACT

A tool component is provided which has particular application in the cutting tool of a mining machine for cutting a variety of soft materials such as coal. The tool component has an elongate stud 12 and a composite abrasive compact 14 located in a recess 20 formed in one end thereof. The recess and composite abrasive compact are surrounded by a shoulder portion 22 which provides, in use, a protective surface for the cutting tool.

5 Claims, 2 Drawing Figures

TOOL COMPONENT

BACKGROUND OF THE INVENTION

This invention relates to tool components and more particularly to tool components which utilise abrasive compacts as the cutting edge or surface.

Abrasive compacts are well known in the art and are used extensively in industry for the abrading of various workpieces. They consist essentially of a mass of abrasive particles present in an amount of at least 70 percent, preferably 80 to 90 percent, by volume of the compact bonded into a hard conglomerate. Compacts are polycrystalline masses and can replace single large crystals. The abrasive particles of compacts are invariably ultrahard abrasives such as diamond and cubic boron nitride.

Abrasive compacts generally contain a second phase or bonding matrix which contains a catalyst (also known as a solvent) useful in synthesising the particles. In the case of cubic boron nitride, examples of suitable catalysts are aluminium or an alloy of aluminium with nickel, cobalt, iron, manganese or chromium. In the case of diamond, examples of suitable catalysts are metals of Group VIII of the Periodic Table such as cobalt, nickel or iron or an alloy containing such a metal. Diamond and cubic boron nitride compacts are manufactured under conditions of temperature and pressure at which the abrasive particle is crystallographically stable. Consequently, compacts include a considerable amount of direct particle-to-particle bonding.

Abrasive compacts may be bound directly to a tool or shank for use. Alternatively, they may be bonded to a backing such as a cemented carbide backing prior to being mounted on a tool or shank. Abrasive compacts bonded to cemented carbide support backings are known in the art as composite abrasive compacts. Bonding of the abrasive compact to the support backing may be achieved directly or through a metal bonding layer. Examples of patent specifications describing abrasive compacts, composite abrasive compacts and their manufacture are U.S. Pat. Nos. 3,743,489, 3,767,371, 4,063,909 and 3,745,623.

Cutting components for drill bits and utilising composite abrasive compacts have been described in the literature and have been used commercially. Such cutting components comprise an elongate pin of cemented carbide to which is bonded a composite abrasive compact, bonding being achieved through the carbide support of the composite abrasive compact. Bonding between the carbide support and the elongate pin is achieved by a braze metal which has a melting point above 700° C. Such a high temperature braze, so the art teaches, is essential in order to achieve a sufficiently strong bond between the composite abrasive compact and the elongate pin. Reference in this regard may be had to the disclosures of U.S. Pat. No. 4,225,322.

It has recently been proposed to use abrasive compacts and composite abrasive compacts as tool inserts for mining machines of the kind which are used to cut a variety of soft materials such as coal. In mining machines of this type, a plurality of cutting tools (also known as picks) are positioned on a working surface, for example, on the surface of a drum, and moved in a cutting direction against the face of the material to be cut. Each tool comprises a holding lug and an insert usually secured in a bore or socket in the lug. The cutting edge or surface of the insert is made of a wear-resistant material such as cemented carbide or abrasive compact.

SUMMARY OF THE INVENTION

According to the present invention, there is provided a tool component comprising an elongate cemented carbide stud, a recess formed in one end of the stud, the stud having surfaces sloping away from the recess, and a composite abrasive compact or an abrasive compact located in the recess and bonded to the stud and presenting an abrasive compact cutting edge or surface.

The shoulder, being made of cemented carbide, provides the tool component with a wear-resistant surface surrounding the abrasive compact or composite abrasive compact. This wear-resistant surface may be used to protect the area surrounding the socket of a holding lug for a tool component of a mining machine of the type described above. Thus, there is provided according to another aspect of the invention, a cutting tool for a mining machine comprising a holding lug, one end of which is adapted for mounting in a working surface of the machine and the other end of which has a socket formed therein, and a tool component as described above so located in the socket that the abrasive compact edge or surface is presented for use and the shoulder provides a protective surface for the area of the lug around the socket.

DETAILED DESCRIPTION OF THE INVENTION

Figure 1:
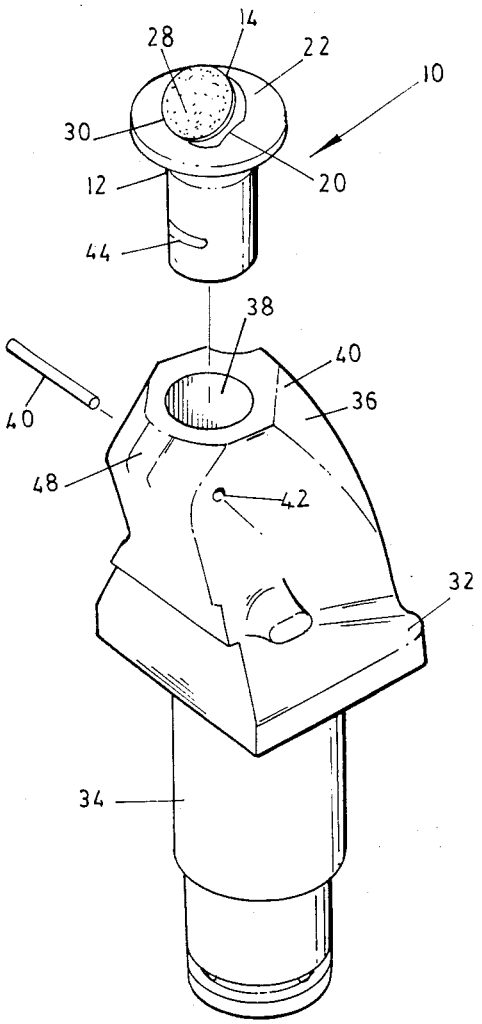
FIG. 1 illustrates an exploded perspective view of a cutting tool utilising a tool component of the invention.
Figure 2:
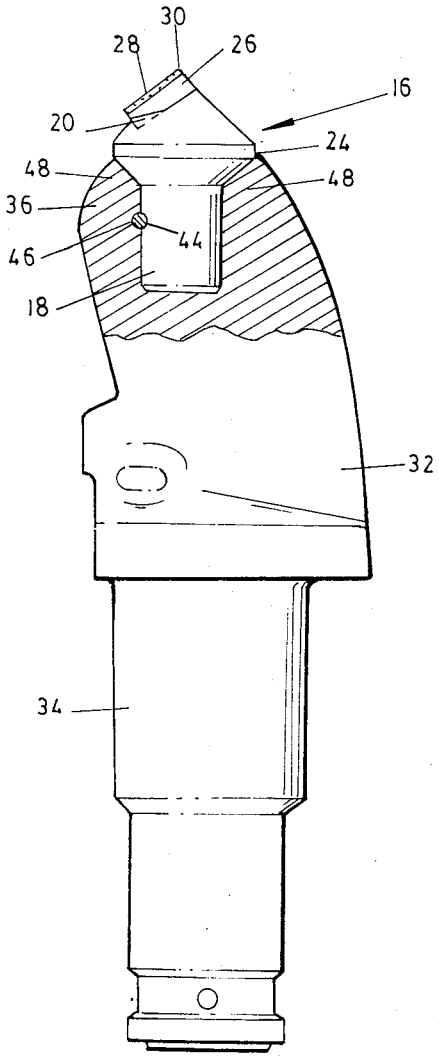
FIG. 2 illustrates a partially sectioned side view of the cutting tool.

In one form of the invention, the tool component is such that in the stud, the shoulder surfaces slope to a first zone of larger cross-section than the recess and the outer surfaces of the stud beyond the first zone slope in to a second zone. The second zone is typically cylindrical in shape. The first zone may be of circular section.

The recess will generally be circular in plan as the compacts and abrasive compacts which are used are generally of disc shape.

In a preferred form of the invention, it is a composite diamond abrasive compact which is located in the recess and bonded to the stud.

The cemented carbide may be any known in the art, typically cemented tungsten carbide.

The tool component may be secured in the socket of the holding lug by methods known in the art such as brazing, glueing, mechanically or a combination thereof.

An embodiment of the invention will now be described with reference to the accompanying drawings which illustrate the use of a tool component of the invention in a cutting tool for a mining machine of the kind which is used to cut coal.

Referring to these drawings, there is shown a tool component 10 comprising an elongate cemented carbide stud 12 and a composite abrasive compact 14. The elongate stud 12 comprises a widened section 16 and a right-circular cylindrical section 18 which together form an integral whole. The widened section 16 has a circular recess 20 which receives the composite abrasive compact 14.

The section 16 of the stud has a surface 22 which slopes away from the recess 20 to a central portion 24 of circular section. From the central portion 24 the section 16 slopes back in to the cylindrical section 18. Thus, the surface 22 provides a shoulder which completely surrounds the recess and the composite abrasive compact located therein.

The composite abrasive compact consists of a carbide support 26 to which is bonded an abrasive compact 28. The edge 30 of the compact provides the cutting edge for the component. The carbide support 26 may be bonded to the stud 12 using any suitable braze known in the art. The braze and conditions of brazing should be so chosen as to ensure that the abrasive compact 28 is not degraded during brazing. Suitable brazes and brazing conditions are well known in the art.

As illustrated by the drawings, the tool component is used as an insert for a cutting tool of a mining machine. The cutting tool comprises a holding lug 32, one end 34 of which is shaped for mounting in the drum surface of a conventional mining machine, and the other end 36 of which is provided with a socket 38 for receiving the tool component. The socket 38 is so shaped that it receives the portion of the stud 12 below the circular central portion 24. Thus, the shoulder provided by surface 22 and the composite abrasive compact stand proud of this end of the holding lug. In particular, surface 22 defines a conical surface, and the upper portion of the holding lug is completely within the imaginary downward continuation of this conical surface.

The tool component is secured in the socket mechanically by use of pin 40. Pin 40 engages in a complementally shaped hole 42, one half 44 of which is formed in the cylindrical section 18 of the stud and the other half 46 of which is formed in the lug.

In use, it is the edge 30 which performs the cutting action. Abrasive chips are produced during cutting and many of these will strike the carbide shoulder provided by surface 22. This carbide shoulder is wear-resistant and thus protects the area 48 of the holding lug which is generally made of hardened steel. It will be noted that the central portion 24 extends beyond the edge of this area. Undercutting of the steel in this area of the lug, which has been a significant problem of prior art cutting tools of this type, is thus effectively eliminated.

I claim:

1. A tool component for use with a holding lug including an upper portion, and comprising:

an axially extending cemented carbide stud defining an axis and including a top recess; and a component abrasive compact secured within said top recess, extending outward therefrom, and forming an abrasive compact cutting edge or surface;

the stud including (i) a bottom portion for connecting the tool component to the upper portion of the holding lug, (ii) a top conical portion having an outside conical surface sloping downwardly, radially outwardly from the abrasive compact and forming a circumferentially extending shoulder radially projecting outside said abrasive compact, circumferentially completely therearound, to deflect away from the holding lug material cut by the cutting edge or surface, and (iii) a central portion located between the bottom and top portions of the stud to space top portion from the holding lug to facilitate positioning the upper portion of the holding lug completely inside the space bounded by an imaginary downward continuation of said conical surface.

2. A tool component according to claim 1 for use with a holding lug including a socket having a cylindrically shaped lower portion to receive the bottom portion of the stud, and a conically shaped upper portion extending upwardly radially outwardly from said cylindrically shaped lower portion, and wherein:

the bottom portion of the stud has a cylindrical shape to fit in the lower portion of the socket; and the stud further includes a lower conical portion having an outside surface sloping downwardly radially inwardly from the central portion, and shaped to fit complementary in the upper portion of the socket in the holding lug.

3. A cutting tool for a mining machine comprising:

a holding lug for connecting the tool to the mining machine, and including a first end portion having a socket; and a tool component including:

(i) a cemented carbide stud including a bottom portion secured within the socket to connect the tool component to the holding lug, and a top conical portion having a top recess, and (ii) a composite abrasive compact secured within the top recess, extending outward therefrom, and forming an abrasive compact cutting edge or surface, the top conical portion of the stud further including an outside shoulder radially projecting outside the abrasive compact, circumferentially completely therearound, and defining a conical surface;

where the first end portion of the holding lug is located completely within the space bounded by an imaginary downward continuation of said conical surface, and the shoulder deflects away from said first end portion of the holding lug material cut by the cutting edge of surface.

4. A cutting tool according to claim 3 wherein the carbide stud further includes a central portion extending above the first end portion of the holding lug and below the shoulder of the stud to space said shoulder from the holding lug to facilitate locating the first end portion of the holding lug completely within the space bounded by the imaginary downward continuation of said conical surface.

5. A cutting tool according to claim 4 wherein:

the socket includes a cylindrically shaped lower portion, and a conically shaped upper portion extending upwardly radially outwardly from the lower portion;

the bottom portion of the stud has a cylindrical shape and fits in the lower portion of the socket; and the stud further includes a lower conical portion having an outside surface fitting complementarily in the upper portion of the socket.

* * * * *